US005606151A

United States Patent [19]

Siekierka et al.

[11] Patent Number: 5,606,151

[45] Date of Patent: Feb. 25, 1997

[54] TWISTED PARALLEL CABLE

[75] Inventors: Thomas J. Siekierka, Downers Grove, Ill.; Robert D. Kenny, Oxford, Ohio

[73] Assignee: Belden Wire & Cable Company, Richmond, Ind.

[21] Appl. No.: 32,149

[22] Filed: Mar. 17, 1993

[51] Int. Cl.[6] ..... H01B 11/02

[52] U.S. Cl. ..... 174/113 R; 174/110 R; 174/128.1; 174/128.2

[58] Field of Search ..... 174/34, 110 AR, 174/110 R, 113 R, 114 R, 126.1, 128.1, 128.2, 113 A, 113 AS, 113 C, 108, 109; 156/47, 51, 55

[56] References Cited

U.S. PATENT DOCUMENTS

| | | | |
|---|---|---|---|
| 3,102,160 | 8/1963 | Cook et al. | 174/105 R |
| 3,761,842 | 9/1973 | Gandrud | 174/34 X |
| 3,921,381 | 11/1975 | Vogelsberg | 174/32 |
| 4,020,213 | 4/1977 | Berglowe, Jr. et al. | 174/10 V X |
| 4,356,345 | 10/1982 | Gonia | 174/117 F |
| 4,449,012 | 5/1984 | Voser | 174/70 A |
| 4,486,619 | 12/1984 | Trine et al. | 174/34 |
| 4,873,393 | 10/1989 | Friesen et al. | 174/34 |
| 4,933,513 | 6/1990 | Lee | 174/115 |
| 5,010,210 | 4/1991 | Sidi et al. | 174/34 |
| 5,015,800 | 5/1991 | Vaupotic et al. | 174/34 |
| 5,103,067 | 4/1992 | Aldissi | 174/36 |
| 5,142,100 | 8/1992 | Vaupotic | 174/24 |
| 5,162,609 | 11/1992 | Adriaenssens et al. | 174/34 |
| 5,245,134 | 9/1993 | Vana, Jr. et al. | 174/117 F |
| 5,283,390 | 2/1994 | Hubis et al. | 174/36 |

*Primary Examiner*—Bot L. Ledynh

*Attorney, Agent, or Firm*—Laff, Whitesel, Conte & Saret, Ltd.

[57] ABSTRACT

This patent describes a cable which is exceptionally suitable for high frequency signal transmission which includes at least two adjoined insulated conductors which are twisted together to form a pair. The pair(s) of adjoined insulated conductors are preferably encased within a thermoplastic, fluorocopolymer, or rubber type material. The embodiment may employ a metallic shield under the encasement. The variation of center to center conductor spacing within a pair as described above should be less than a value equal to about 0.03 times the statistical average of the center to center conductor spacing. The preferred cable has an average impedance of 90 to 110 ohms with a tolerance of ±5% when measured at high frequencies along any 1000 ft. of cable. Additionally, the two adjoined insulated conductors should have an adhesion strength of no more than 5 lbs. force.

1 Claim, 1 Drawing Sheet

TWISTED PARALLEL CABLE

The present invention relates to twisted pair cables which can be used in high frequency applications and more particularly, the present invention relates to high frequency twisted pair cables having a common dielectric layer surrounding the pair of conductors.

BACKGROUND OF THE INVENTION

In the past, twisted pair cables were utilized in applications where data speeds reached an upper limit of about 20 kilobits per second. Recent advances in wire technology and hardware equipment have pushed the upper limit of twisted pair cable applications to about several hundred megabits per second.

Twisted pair technology advances have primarily focused on near end crosstalk. Both U.S. Pat. No. 3,102,160 and U.S. Pat. No. 4,873,393 teach the importance of utilizing pairs which are twisted with lengths of lay different from integral multiples of the lengths of lay of other paired conductors within the cable. This is done to minimize electrical coupling between paired conductors.

U.S. Pat. No. 5,015,800 focuses on another important issue of maintaining a controlled impedance throughout the transmission line. It teaches how impedance can be stabilized by the elimination of air gaps around a twisted pair embodiment through the use of a dual dielectric.

Several problems still exist which limit the use of twisted pair cabling. A primary concern is with the control of center to center conductor spacing. In a typical twisted pair cable, if pair one has a differentiation of only 0.002" in center to center conductor separation from pair two, a 6 ohm difference in average impedance can result. This is a fundamental reason why twisted pair cables have impedance tolerances of no better than +/−10%.

When two or more pairs of different average impedance are connected together to form a transmission line (often referred to as a channel), part of the signal will be reflected at the point of attachment(s). Reflections due to impedance mismatch ultimately causes problems with signal loss and tracking errors (jitter).

Prior attempts to control conductor spacing has been entirely for the purposes of stabilizing capacitance within a cable. It is well known in the industry that utilizing a cable with uniform capacitance between its pairs has the advantage of reducing crosstalk. U.S. Pat. No. 3,102,160 explains how equal and uniform capacitance can be achieved along a transmission line by simultaneously extruding dielectric over two conductors.

However, U.S. Pat. No. 3,102,160 did not recognize problems encountered with impedance mismatch at high frequencies. The impedance of the cable was of little importance provided the capacitance of each pair within the cable was relatively uniform. The problem is in that different cables can have uniform capacitances between their respective pairs and yet possess different average impedances.

To solve this problem, it becomes necessary not only to control the center to center conductor spacing of pairs within a particular cable, but to provide a consistent documented center to center conductor spacing requirement on all cables of a particular design. In this way, potential impedance mismatches between cable to cable connections will be held to a minimum. This improvement will ultimately allow more energy to be delivered to a receiving unit. Additionally, the signal will not be as distorted when compared to a typical twisted pair cabling structure due to decreased reflections along the channel.

Another problem with the U.S. Pat. No. 3,102,160 is with regard to insulated conductor separation. In order for the pairs of the said cable to be used with current LAN systems and connecting hardware, the adjoined insulated conductors must have the ability to be separated from one another for at least 1 inch along the length of the pair. The prior art provides no means for the separation of the two adjoined insulated conductors.

Generally in use today we have cables consisting of twisted pair groups, each group being formed from separate insulated conductors. These separate twisted pair cables can be effective in providing electrical energy in low frequency applications. These twisted pair cables have been used in applications ranging from telephone interconnect to LAN systems. The frequency range of these cables have been traditionally limited to about 10 MHz. With the advent of additional equipment such as media filters and signal regenerators, cables consisting of pairs which embody individually insulated conductors are beginning to run at speeds of several hundred MBps (Mega Bits per Second). However, this extra equipment can add subsequent cost to the overall system. As a result, many people still elect to install coax, which is generally regarded as a more electrically consistent cable media.

One reason why twisted pair cables are restricted in frequency is that they often have higher structural variation when compared to their coaxial counterpart. These variations can and will result in loss of energy via electrical reflections within the cable. The main cause for the increased variation is due to the elevated inconsistency of conductor to conductor spacing after twinning. This is especially evident with insulated conductors possessing poor concentricity. Additionally, increased variation of conductor to conductor separation can be a result of loosely twisted insulated conductors. This is because of varying air gaps which form between them.

Structural variations, such as those caused by less than desired concentricity within the insulated conductors of the twisted pair cause energy to be reflected back towards the source due to the subsequent changes in the impedance along the cable paths. Since the structural variations are cyclical along the transmission line, the impedance effect is additive, and what begins as a small discontinuity usually will turn into a major discontinuity. This reflected energy caused by structural variations is called return loss, and is considered lost power that is no longer useful to the system. Moreover, along with the return loss caused by the structural variations, the reflected wave can also be re-reflected at the source input, which may cause data errors at the receiving end.

Accordingly, it is an object of this invention to provide a twisted pair cable having a pair of insulated conductors joined along their length and twisted and said twisted conductors having a center-to-center distance varying over any 1000 ft. length of ±0.03 times the statistical average to reduce the structural variations normally associated with twisted pair cables and allowing more energy to be delivered to a receiving unit.

It is a further object of this invention to provide a twisted pair cable that allows for tighter tolerance of characteristic impedance, thereby reducing the potential for mismatch.

Accordingly, it is another object of this invention to provide a twisted pair cable with minimal structural variations to reduce the amount of reflected signal along the transmission line and approach the highly desired electrical uniformity of coaxial cable.

In accordance with these and other objects, a twisted pair cable is provided that can be used in high frequency applications. In one embodiment, the twisted pair cable has a pair of spaced central conductors surrounded by a dielectric(s) layer or insulation. The dielectric(s) layer is a pair of spaced cylinders longitudinally connected by an integral web. The conductors are substantially concentric with the dielectric layer and adhere to the inner wall of the dielectric layer to prevent relative rotation between the conductors and the dielectric layer.

The two dielectric layered conductors are interconnected by an integral solid webbing. The webbing preferably extends substantially the length of the wires and interconnects the diametrical axes of the dielectric layer over each conductor. In addition, preferably, the webbing has a thickness and width that are less than the thickness of the dielectric layer adjacent to the conductors. The dual conductor surrounded by the dielectric(s) layer is twisted to form a twisted pair cable. The variation in the distance between the centers of adjacent conductors, the center-to-center distances, along the twisted pair cable is very small. The center-to-center distance at any one point along the twisted parallel cable does not vary by more than ±0.03 times the statistical average of center-to-center distances measured along the twisted parallel cable.

Because the conductors are unable to rotate relative to each other and also are unable to form air gaps between adjacent insulated conductors, the structural variations are reduced. Thereby the return loss normally associated with twisted pairs is reduced. Additionally, the twisted pair cable allows for tighter tolerance of characteristic impedance, thereby reducing the potential for mismatch between successive cable runs.

In another embodiment of the present invention, single insulated conductors are affixed together substantially along their entire length by an appropriate adhesive or attached before the dielectric layers of adjacent wires are hardened. The adhesive is any appropriate dielectric adhesive for the conductor dielectric layer. Also, the twisted pair cable of our invention has an average impedance of about 90 to about 110 ohms when measured at high frequencies of about 10 MHz to about 200 MHz with an impedance tolerance of ±5% of a statistical average measured from randomly selected 1000 ft. cable of the same size taken from successive runs.

Our invention also permits the two attached (by web, adhesive or equivalent) insulated singles to be separated at a later time. Our insulated single conductors which are attached, have an adhesion strength of not more than 5 lbs. force. When being used in patch panels, punch down blocks, and connectors, it becomes necessary for the two singles to be segregated from each other. The spread can be up to one inch or more. With Twin-Lead type technology, the two wires cannot be uniformly detached—a distinct disadvantage when compared to our invention. It should also be noted that many connectors, such as the commonly used RJ-45 jack, require that the individual singles be uniformly round. With our invention, once the singles are detached, they will retain their roundness independent of each other.

The present invention and advantages thereof will become more apparent upon consideration of the following detailed description when taken in conjunction with the accompanying drawings.

DETAILED DESCRIPTION OF THE INVENTION

Figure 1:
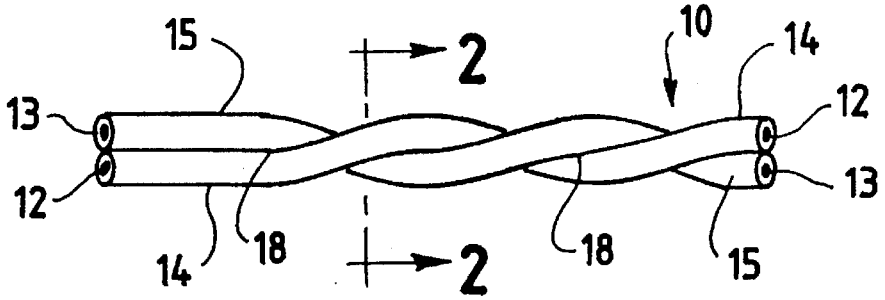
FIG. 1 is a side view of a twisted pair cable in accordance with a preferred embodiment of the invention.
Figure 2:
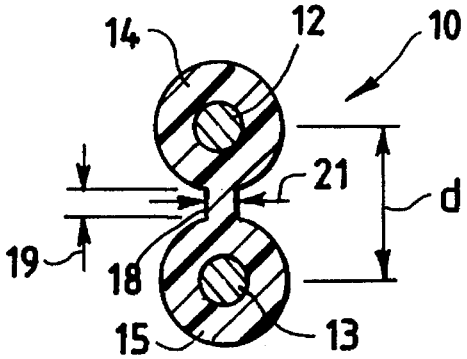
FIG. 2 is an enlarged cross section taken along lines 2—2 of FIG. 1.

FIGS. 1 and 2 show one embodiment of a twisted pair flat cable 10 that can be used in high frequency applications. The cable 10 has two solid, stranded or hollow conductor wires 12 and 13. The conductors are solid metal, a plurality of metal strands, an appropriate fiber glass conductor, a layered metal or combination thereof. Each conductor 12 and 13 is surrounded by a respective dielectric or insulating cylindrical layer 14 and 15. Each of the wires 12 and 13 is disposed centrally within the corresponding insulation 14 and 15. The wires may, if desired, adhere to any degree against the inner walls of the insulation by any suitable means, such as by bonding by heat or adhesives.

The insulations 14 and 15 are integral with each other and are joined together along their lengths in any suitable manner. As shown, the joining means is a solid integral web 18 which extends from the diametric axis of each insulation. The width 19 of the web is in the range of from about 0.00025 to about 0.150 inches. The thickness 21 of the web is also in the range of from about 0.00025 to about 0.150 inches.

The diameter (traditionally expressed in AWG size) of each of the conductors 12 and 13 are preferably between about 18 to about 40 AWG.

The conductors 12 and 13 may be constructed of any suitable material, solid or strands, of copper, metal coated substrate, silver, aluminum, steel, alloys or a combination thereof. The dielectric may be suitable material used in the insulation of cables such as polyvinylchloride, polyethylene, polypropylene or fluoro-copolymers (such as Teflon, which is a registered trademark of DuPont), cross-linked polyethylene, rubber, etc. Many of the insulations may contain a flame retardant. The thickness of the dielectric layer 14 and 15 is in the range of from about 0.00025 to about 0.150 inches.

Figure 3:
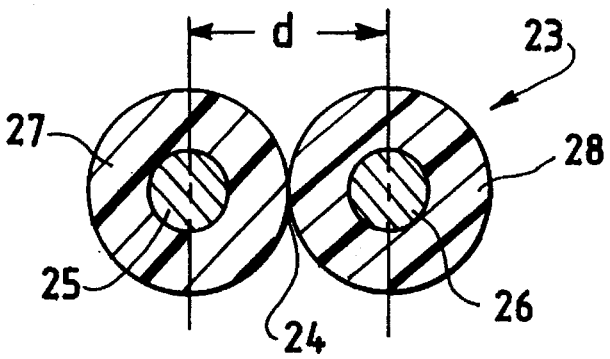
FIG. 3 is an enlarged cross-sectional view of another embodiment of a twisted pair cable.

FIG. 3 illustrates another embodiment of our invention. The twisted pair cable 23 is joined or bonded together by an appropriate adhesive 24. The thickness of the adhesive shown in FIG. 3 is atypical when compared to classical design application. The size of the adhesive is enlarged disproportionately to illustrate the bonding. Instead of an adhesive, the adjacent dielectrics can be bonded together by causing material contact while the dielectrics are at elevated temperatures and then cooling to provide a joined cable having no adhesive. The conductors 25 and 26 have an AWG size of from about 18 to about 40. The thickness of the dielectric insulation coating 27 or 28 is from about 0.00025 to about 0.150 inches.

The adhesive 24 or web 18 are such that the dielectric layers can be separated and remain intact with an adhesion strength of not more than 5 lbs. force.

Any number of twisted pair cables may be incorporated into an overall jacketed or unjacketed cable with an optional metallic shield under the encasement, or applied over each twisted pair.

The cables 10 and 23 both provide for relatively error free transmissions within most frequencies utilized by LAN systems. The invention is manufactured in such a way as to provide stable electricals beyond current LAN capabilities over twisted pair cables.

One way to measure the amount of structural variation in a cable is by sending a signal along the transmission line (cable path) and measuring the amount of energy reflected back towards the testing apparatus. Sometimes the reflected electrical energy peaks at particular frequencies (often referred to as "spikes" within the cable industry). This is the result of a cylindrical variation in the construction which matches the cyclical wave (or frequency) propagating down the cable. The more energy reflected back, the less energy is available at the other end of the cable.

The actual reflected energy can be predicted by the impedance stability of the transmission line. If a 100 ohm impedance signal is sent down the cable, any part of the cable which is not exactly 100 ohms will cause a reflection. The impedance of the cable is controlled by two main factors; conductor spacing and dielectric between the conductors. The more uniform the conductor spacing and dielectric, the more uniform the impedance.

An important feature of the present invention is that our twisted pair cable has a center-to-center distance d measured between the centers of adjacent conductors of ±0.03 times the statistical average of d with the variation being not any more than this.

To measure the variation of d in our twisted pair cables, we randomly select at least three and preferably twenty 1000 ft. samples of cable of the same size from at least three separate successive runs with each of the runs occurring on a separate day or 24 hour period. The average d is calculated by taking at least 20 measurements on each 1000 ft. cable with each measurement taken at least 20 ft. apart and dividing by the total number of measurements taken. All of the d measurements for our cable fall within the tolerances of ±0.03 times the average d.

For example, in one of our typical 24 AWG cables not produced in conformance with the present invention and having a dielectric layer with a center to center conductor spacing of 0.035 inches, the average d in inches for three 1000 ft. lengths of cable with 20 measurements taken at least 20 ft. intervals is:

| Sample | Cable 1(d) | Cable 2(d) | Cable 3(d) |
|---|---|---|---|
| 1 | .0355 | .0364 | .0344 |
| 2 | .0352 | .0368 | .0340 |
| 3 | .0358 | .0364 | .0341 |
| 4 | .0353 | .0357 | .0346 |
| 5 | .0348 | .0352 | .0344 |
| 6 | .0340 | .0356 | .0348 |
| 7 | .0347 | .0356 | .0352 |
| 8 | .0349 | .0359 | .0345 |
| 9 | .0355 | .0367 | .0341 |
| 10 | .0362 | .0362 | .0347 |
| 11 | .0367 | .0366 | .0352 |
| 12 | .0363 | .0363 | .0350 |
| 13 | .0354 | .0356 | .0356 |
| 14 | .0348 | .0347 | .0354 |
| 15 | .0345 | .0355 | .0351 |
| 16 | .0344 | .0352 | .0345 |
| 17 | .0351 | .0359 | .0344 |
| 18 | .0356 | .0363 | .0341 |
| 19 | .0351 | .0366 | .0336 |
| 20 | .0347 | .0368 | .0335 |
| TOTAL | .7045 | .7194 | .6912 |
| CABLE TOTALS 1 + 2 + 3 DIVIDED BY 60 | | | .0353 |

Since in the above example, the cables expose a measurement outside the tolerance of the average d (center to center conductor spacing) ±0.03 times the average d, the cable would be rejected. In this case, the range of acceptable d is from 0.0342 to 0.0364 inches, i.e., 0.0353 (the average) ±0.0011 (0.03×0.0353). Since in the above example there are measurements outside this tolerance, the cable would be rejected.

An alternative and/or combined feature of our twisted pairs 20 and 23 is that each have an impedance of from 90 to 110 ohms when measured at high frequencies of about 10 MHz to about 200 MHz with a tolerance of no greater than ±5%. The tolerance is determined by multiplying ±0.05 times an average impedance; the average impedance is calculated by averaging the impedances of at least 20 random samples of 1,000 feet cable of the same size. The cables being taken from at least three separate successive runs on at least three separate days.

Further, the adhesion strength of the twisted pair 20 and 23 is such that the wires may be pulled apart after an initial cut by finger nail or appropriate tool by hand with the same or less pull that is needed to remove a normal band aid from a scratch.

The pulling apart of the wires for at least an inch, leaves the insulation 14, 15 and 27, 28 substantially intact over the separated portion and does not disturb the twist. This adhesion feature is one of the features of the present invention. The wires 10 and 23 can be separated without causing the twist to unravel and separate. Further, this feature provides a cable which can be attached to a connector without disrupting the impedance tolerance of the twisted pair cable.

The adhesion strength is determined by holding one insulated conductor and pulling the other insulated conductor. The adhesion strength of the twisted cables 10 and 23 that substantially leaves the insulation 14 and 15 and 27 and 28 substantially intact is between 0.1 and 5 lbs. force and preferably between 0.25 and 2.5 lbs. force.

The twisted pair cables 10 and 23 are prepared by extruding insulation over two wires simultaneously and then adhering the two insulated conductors via bonding, webbing, or other suitable means. The adjoined insulated conductors are twisted to produce the desired number of twists per paired wire cable length.

The twisted wire cable 23 is preferably prepared by the side-by-side coating of two conductors, joining the two conductors prior to winding the wires, optionally using an adhesive to bond the two coated wires, and after bonding of the two wires, twisting the joined insulated wires to the desired twist.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A twisted pair cable comprising:

two conductors, a dielectric layer surrounding each conductor, said dielectric layers being joined together along the length of said dielectric layers, said conductors and corresponding dielectric layers being twisted substantially along the length of said cable to provide the twisted pair cable having an adhesion strength between said dielectric layers of from about 0.1 to about 5 lbs. force, the twisted pair cable has a center-to-center distance at any point along the twisted pair cable that does not vary by more than ±0.03 of an average center-to-center distance with said average center-to-center distance being an average of at least 20 center-to-center distance measurements on each of three randomly selected 1,000 ft. twisted cables of the same size taken with each measurement being taken at least 20 feet apart and taken from at least three separate successive runs with each run being on a separate day, and said twisted pair cable has a first average impedance of about 90 to 110 ohms when measured at high frequencies of about 10 MHz to about 200 MHz, an impedance tolerance being no greater than ±0.05 of a second average impedance, and said second average impedance being an average of at least one impedance measurement on each of at least twenty 1,000 ft. twisted pair cables of the same size, taken from the same run.

* * * * *